United States Patent [19]

Lee

[11] Patent Number: 4,890,992

[45] Date of Patent: Jan. 2, 1990

[54] SCREW-ROTOR MACHINE WITH AN ELLIPSE AS A PART OF ITS MALE ROTOR

[75] Inventor: Hou-Teng Lee, Taipei, Taiwan

[73] Assignee: Fu Sheng Industry Co., Ltd., Taipei, Taiwan

[21] Appl. No.: 184,942

[22] Filed: Apr. 22, 1988

[51] Int. Cl.[4] ..... F04C 18/16

[52] U.S. Cl. ..... 418/201; 74/466

[58] Field of Search ..... 418/150, 197, 201 B; 74/458, 466

[56] References Cited

U.S. PATENT DOCUMENTS 3,622,256 11/1971 Borisgoglebsky et al. ..... 418/201 B 4,406,602 9/1983 Kasuya et al. ..... 418/201 B

FOREIGN PATENT DOCUMENTS 980699 1/1965 United Kingdom ..... 418/201 B

*Primary Examiner*—John J. Vrablik

*Attorney, Agent, or Firm*—Brumbaugh, Graves, Donohue & Raymond

[57] ABSTRACT

A screw-rotor machine with two meshing rotors provides with helical lands and intervening grooves and adapted for rotation around parallel axes in a working space in the machine, characterized in that; the profile of rotors uses ellipse as a basic geometry generating curve on the male rotor.

3 Claims, 3 Drawing Sheets

SCREW-ROTOR MACHINE WITH AN ELLIPSE AS A PART OF ITS MALE ROTOR

BACKGROUND OF THE INVENTION

This invention relates to a screw-rotor machine with two screw rotors and more particularly to the profile of the intermeshing rotors for such kind of machine.

As everybody knows, the rotors in screw-rotor machines are provided with helical lands and intervening grooves and are adapted for rotation around parallel axes in a working space in the machine. One of the rotors is named female rotor and so designed that a major portion of each groove is located inside the pitch circle of the female rotor, and a minor portion of each groove is located outside the pitch circle. The second rotor is named male rotor and so designed that a major portion of each land is located outside the pitch circle of the male rotor, and a minor portion of each land is located inside this pitch circle.

Heretofore, a plurality of patents relating to different inventions of rotor profiles for screw-rotor machine have been granted. The prior arts were replete with rotor profiles for machines of the type noted herein, and had brought forth improvement in the performance of the machine. Examplary thereof are U.S. Pat. Nos. 4,028,026, 4,140,445, 4,412,796, 4,435,139 and 4,460,322. But, according to the prior arts, in order to have the rotor profiles with an optimum relation between these two rotors as regards the adiabatic efficiency, the profiles are difficult to designate and complicated to manufacture.

It is an object of this invention to achieve a rotor profile, which meets this optimum relation in order to bring about a screw-rotor machine having an adiabatic efficiency exceeding that has been obtained with heretofore known profiles.

It is further object of this invention to achieve the rotor profiles by a more simplified procedure, that is, to provide a simple process to get the rotor profiles.

SUMMARY OF THE INVENTION

In accordance with the present invention, a pair of intermeshing rotors of a screw-rotor machine have helical lands and intervening grooves and are adapted for rotation about parallel axis within a working space inside the housing of the machine. One of the rotors is of male rotor type, its profile is composed by four curves. The other of the rotors is of female type and is shaped by curves generated by the curves on the male rotor.

A more complete understanding of these and other features and advantages of the present invention will become apparent from a careful consideration of the following detailed description of certain embodiments illustrated in the accompanying drawings.

DETAILED DESCRIPTION OF THE INVENTION

Figure 1:
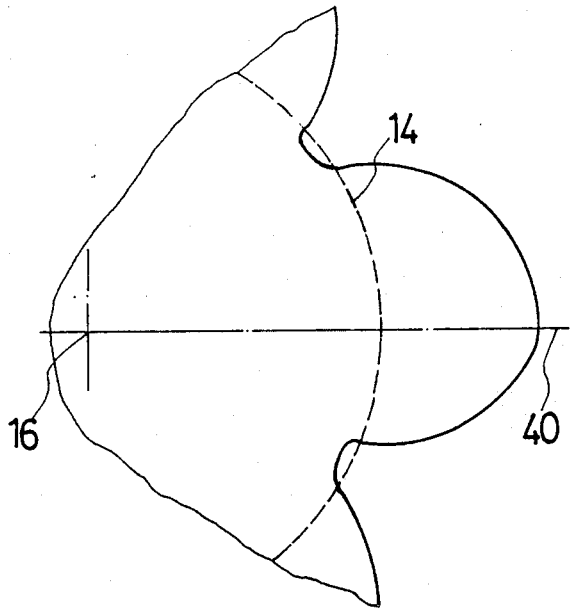
FIG. 1 is a line drawing of a profile of a male rotor defined according to the invention.
Figure 2:
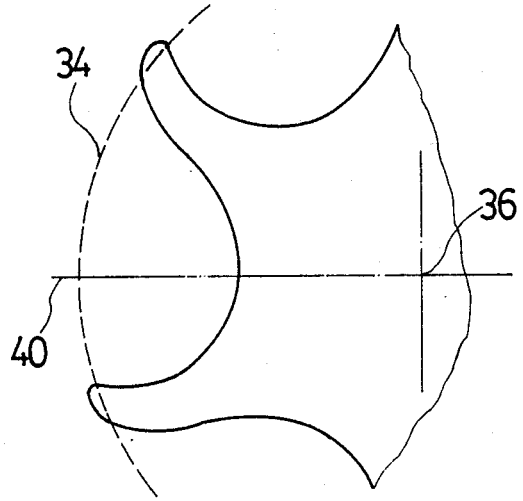
FIG. 2 is a partial line drawing of a profile of a portion of a female rotor defined according to the invention.
Figure 3:
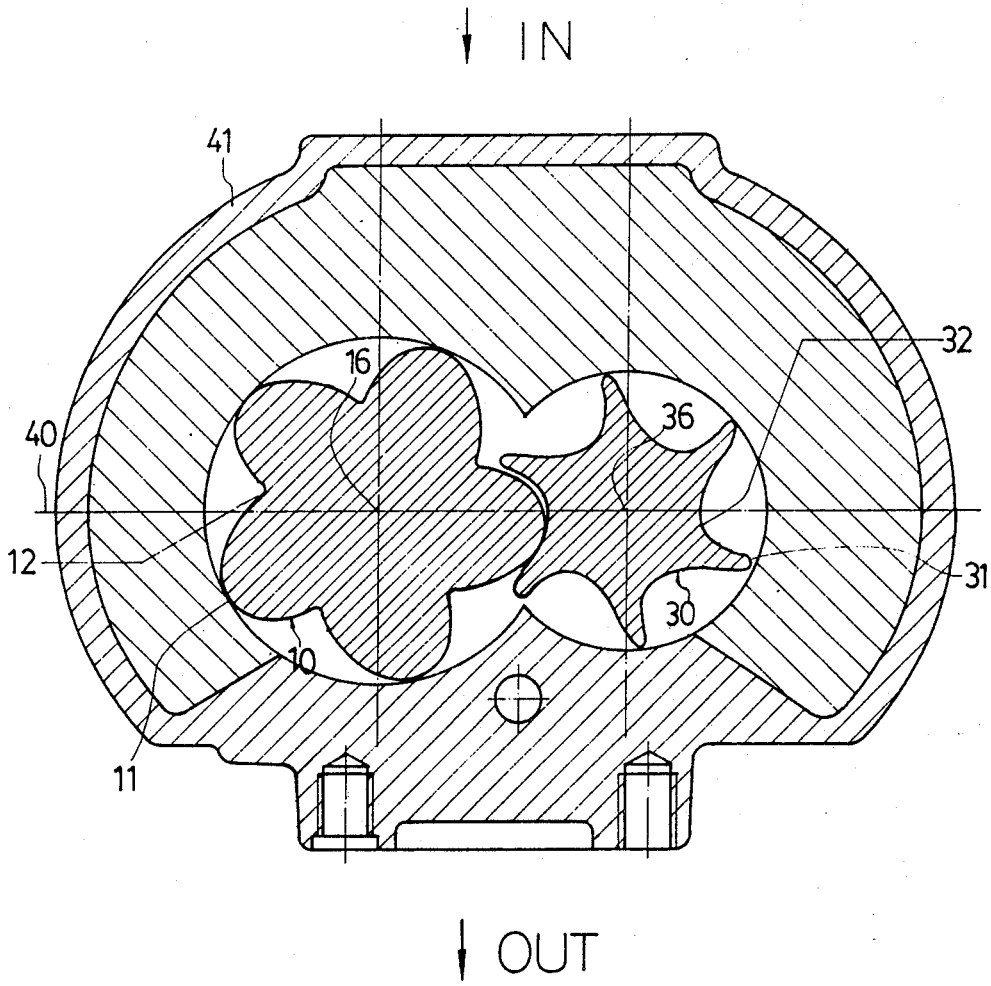
FIG. 3 is a line illustration of the full profiles of the rotors of FIG. 1 and FIG. 2 in coacting engagement.

Referring to FIG. 1 and FIG. 3, the male rotor 10, according to an embodiment of the present invention, has five helical lobes 11 (only one being fully shown in FIG. 1) and a like number of intervening, helical grooves 12 (only two being shown in FIG. 1). Relative to its coacting with the female rotor 30 (FIG. 2), it has a pitch circle 14 and a rotary axis 16. As noted, axis 16 occupies a common plane 40 with the rotary axis of the female rotor, upon the two rotors being disposed in coacting, meshing engagement in the machine housing 41.

Referring to FIG. 2 and FIG. 3, the female rotor 30, according to an embodiment of the invention, has six helical ribs 31 (only two thereof being shown in FIG. 2) and a like number of intervening, helical grooves 32 (not all fully shown). Relative to its coacting with the male rotor 10 (FIG. 3), the female rotor 30 has a pitch circle 34 and a rotary axis 36. The axes 36 and 16, with the rotors 10 and 30 in coacting, meshing engagement, occupy the common plane 40.

Figure 4:
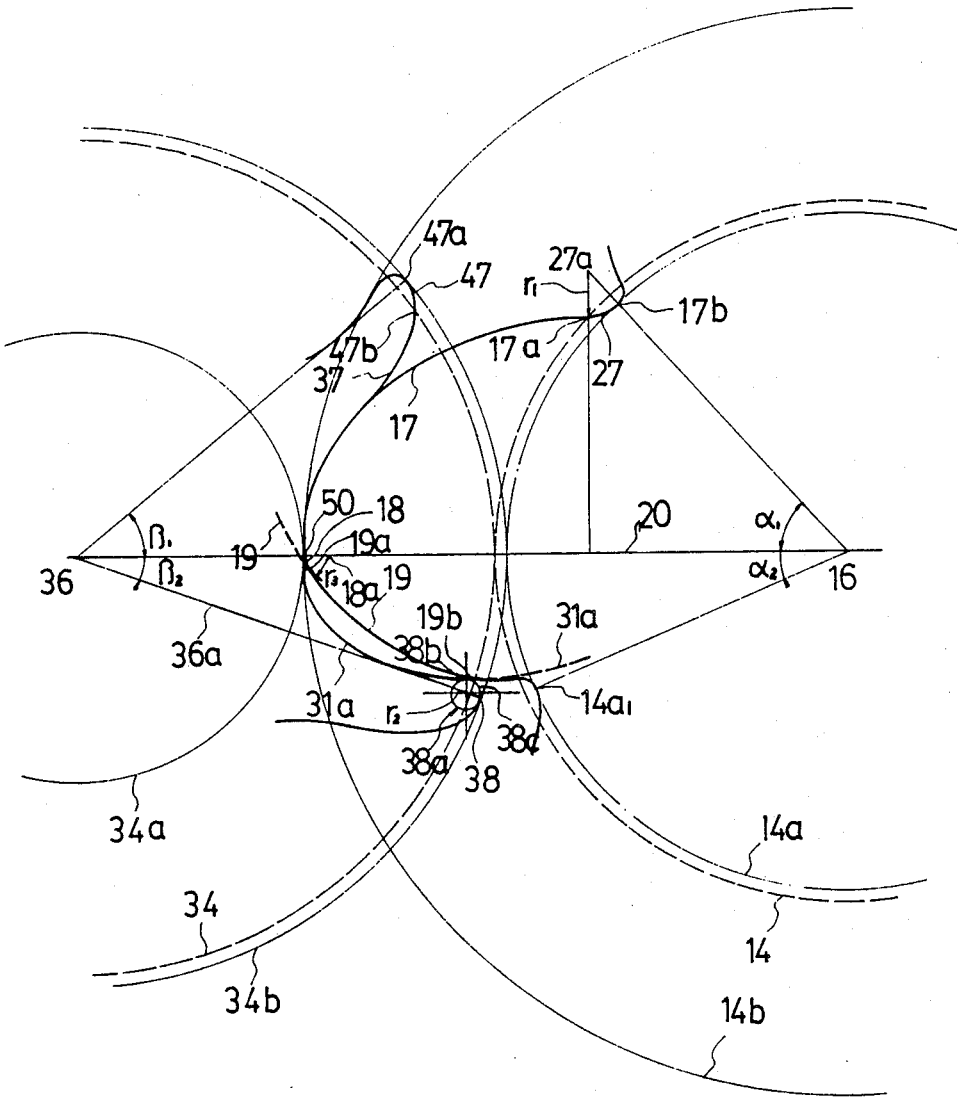
FIG. 4 is a greatly enlarged line illustration, depicting a lobe of the male rotor in coacting engagement with a recess in the female rotor.

Referring to FIG. 4, according to the present invention, the profiles of the female rotor 30 and the male rotor 10 are defined as follows:

Use the rotary axis 36 of the female rotor 30 as circle center, draw circle 34 as pitch circle, then circle **34*a* with radius smaller than the radius of pitch circle as dedendum circle, and circle 34*b*** with radius greater than the radius of pitch circle as addendum circle.

Use the rotary axis 16 of the male rotor 10 as circle center, draw pitch circle 14, dedendum circle **14*a*, addendum circle 14*b* externally tangent to circle 34, 34*b*, 34*a* respectively, while circle 14*b* and 34*a* intersect the plane 40 occupied by axes 16 and 36 at 50**.

Find a moderate ellipse with a curve 17 as a part of it, and make the end of the curve 17 externally tangent to circle **34*a* at point 50, meanwhile, the long axis of the moderate ellipse has to be on line segment 20 between 16 and 36. The curve 17 then generates curve 37** on the profile of female rotor.

At the side of female rotor, find a moderate value to draw a line **36*a* to intersect circle 34*b* at point 38 and define an angle $\beta_2$ between line segment 20 and line 36*a***.

With an optimum length as a radius $r_2$ to find a circle **38*a* tangent to circle 34*b* at point 38 internally, while the circle center of circle 38*a* is on line 36*a*. Arc 38*c*, which is part of a circle 38*a*, is located between points 38 and 38*b* and tangent to the addendum circle of the female rotor and arc 19** and these respective points. The length of radius $r_2$ could not be too large, otherwise, the blow back hole will be too large and will cause leakage of the machine. But a shorter $r_2$ will cause difficulty for machining. As a result, the length of $r_2$ must be larger than 1 mm.

Curve 19 which defines part of the profile of the male rotor is generated by circle **38*a*, that is to say, curve 19 is a curve connects point 19*a* (described in the next paragraph) and point 14*a*$_1$ on circle 14*a*, and curve 19, is tangent to circle 38*a* at point 19*b***.

On the side of male rotor, use a moderate radius $r_3$ with its center **18*a* on line segment 20 to draw an arc 18 tangent to curve 17 and circle 34*a* at point 50, at the same time, arc 18 is also tangent to curve 19 at point 19*a***.

Use arc 18 on male rotor's side to generate curve **31*a*, which is tangent to circle 38*a* at point 38*b***.

Use a radius $r_1$ with moderate length to draw an arc 27 which is tangent externally to curve 17 at point 17*a* and to circle 14*a* at 17*b*, then we get a profile of a male rotor defined according to the invention.

Whereas, point 27*a* is the center of arc 27 with a radius r1, and arc 27 on the male rotor generates curve 47 on the female rotor, that is to say, curve 47 is tangent to circle 34*b* at point 47*a*. Further, a longer $r_1$ will produce a thinner lobe on the female rotor, but a shorter $r_1$ will become more difficult to manufacture, therefore, the proper length of $r_1$ is within the range of 2–5 times of the length of $r_2$.

From the above description, we have the following conclusions:

A. The profile of male rotor is composed by four parts, that is, curve 27, 17, 18 and 19, wherein, curve 17 is a part of an ellipse with long axis laid on the line segment which connects the axis of male rotor and female rotor, and intersects that line segment at point 50; arc 27 is connected and tangent externally to curve 17 and the dedendum circle 14*a*; arc 18 is tangent to curve 17 and connected to curve 17 at point 50; curve 19 is a part of a curve which is generated by part of a circle with small radius r2 on the female rotor.

B. The profile of female rotor is then composed also by four parts, that is, curve 47, 37, 31*a*, 38*c*, wherein, curve 47 is generated by arc 27 on the male rotor; curve 37 is generated by curve 17 on the male rotor; curve 31*a* is part of a curve which is generated by an arc 18 on the male rotor; arc 38*c* is an arc of a circle 38*a* with moderate radius and with its center on the line 36*a* defining a proper angle $\beta_2$.

As described above, the geometrices, relative dimension, and relationships have been carefully derived and defined to yield the improved-performance profiles of the male rotor and femal rotor, and simplified the generation of the profiles.

While the procedure for generation of the profiles is described in connection with specific embodiments thereof, it is to be clearly understood that this is done only by way of example, and not as a limitation to the scope of the invention as set forth in the objects thereof and in the appended claims.

I claim:

1. A screw rotor machine having a female rotor meshing with a male rotor, helical lands and intervening grooves and adapted for rotation around parallel axis in a working space of the machine, the profile of the rotors comprising:

a first curve of the male rotor having an arc of a first circle tangent externally to the dedendum circle of the male rotor and with a center outside the pitch circle of the male rotor, a second curve of the male rotor being part of an ellipse with a long axis laid on a line segment connecting the central axis of the male rotor and female rotor, the second curve intersecting the line segment and tangent externally to the dedendum circle of the female rotor and internally to the addendum circle of the male rotor, wherein the second curve of the male rotor is between the first curve of the male rotor, and the point where the line segment connecting the central axis of the male and female rotor intersects with the dedendum circle of the female rotor and the addendum circle of the male rotor, a first curve of a female rotor being an arc of a second circle tangent internally to the addendum circle of the female rotor, the center of which lies on a line which forms a modulated angle with the line segment connecting the central axis of the male rotor and female rotor, wherein the radius of curvature of the first circle is within the range of 2 to 5 times the radius of curvature of the second circle, a second curve of the female rotor internally tangent to the addendum circle of the female rotor at one end, internally tangent to the second curve of the male rotor and externally tangent to the dedendum circle of the female rotor at a point where the dedendum circle of the female rotor intersects the line segment connecting the central axis of the male rotor and female rotor at the other end, wherein the second curve of the female rotor is generated by the second curve of the male rotor.

2. A screw rotor machine as recited in claim 1 wherein the profile of the male rotor further comprises a third curve of the male rotor internally tangent to the second curve of the male rotor and externally tangent to the dedendum circle of the female rotor at the point where the dedendum circle of the female rotor intersects the line segment connecting the axis of the male rotor and the female rotor, and a fourth curve of the male rotor externally tangent to the second circle, wherein the third curve and the fourth curve are between the second curve of the male rotor and the point on the second circle where the fourth curve is tangent to the second circle.

3. A screw rotor machine as recited in claim 2 wherein the profile of the female rotor further comprises a third curve, which is generated by the third curve of the male rotor, between the second curve of the female rotor and the first curve of the female rotor, said third curve externally tangent to the dedendum circle of the female rotor at the point where the dedendum circle of the female rotor intersects the line segment connecting the central axis of the male rotor and the female rotor and tangent to the second circle at the point where the second circle is externally tangent at the point where the second circle is externally tangent to the fourth curve of the male rotor.

* * * * *